US007435326B2

(12) United States Patent
Beavers et al.

(10) Patent No.: US 7,435,326 B2
(45) Date of Patent: Oct. 14, 2008

(54) CONTROL FOR GALVANIC CORROSION INHIBITING COUPLING

(75) Inventors: John A. Beavers, Hilliard, OH (US); Brett Michael Tossey, Marysville, OH (US)

(73) Assignee: CC Technologies, Inc., Dublin, OH (US)

( * ) Notice: Subject to any disclaimer, the term of this patent is extended or adjusted under 35 U.S.C. 154(b) by 40 days.

(21) Appl. No.: 11/510,394

(22) Filed: Aug. 25, 2006

(65) Prior Publication Data

US 2008/0047842 A1 Feb. 28, 2008

(51) Int. Cl.
*C23F 13/20* (2006.01)

(52) U.S. Cl. ..... 205/726; 205/725; 205/738; 205/740; 204/196.21; 204/196.36; 204/196.37

(58) Field of Classification Search ..... 205/724, 205/725, 727, 730–733, 738, 740; 204/196.21, 204/196.36, 196.37; 73/86
See application file for complete search history.

(56) References Cited

U.S. PATENT DOCUMENTS 5,739,424 A * 4/1998 Beavers ..... 204/196.02

* cited by examiner

*Primary Examiner*—Bruce F Bell
(74) *Attorney, Agent, or Firm*—Frank H. Foster; Kremblas, Foster, Philiips & Pollick

(57) ABSTRACT

A pipe coupling for joining two electrolyte-conveying pipes of electrochemically dissimilar metals and inhibiting galvanic corrosion resulting from the dissimilarity. A tubular pipe coupling has a pair of axially spaced protection electrodes mounted to its interior wall in electrical contact with the electrolyte. A control electrode is also mounted to the interior wall of the tubular pipe coupling between one of the pipes and the pair of protection electrodes. A current sensing circuit is connected to sense the galvanic current through the control electrode. A controllably variable source of electrical current is connected to vary the current through the protection electrodes. A negative feedback control circuit receives the sensed current as a feedback signal and controls the variable source to increase the electrical current through the protection electrodes and the electrolyte so that the sensed current is reduced thereby reducing the galvanic current in the electrolyte between the pipes. Preferably, the feedback control system has a reference input representing zero current through the control electrode and therefore drives the protection current to a magnitude that nulls the control electrode current.

15 Claims, 4 Drawing Sheets

Fig. 1
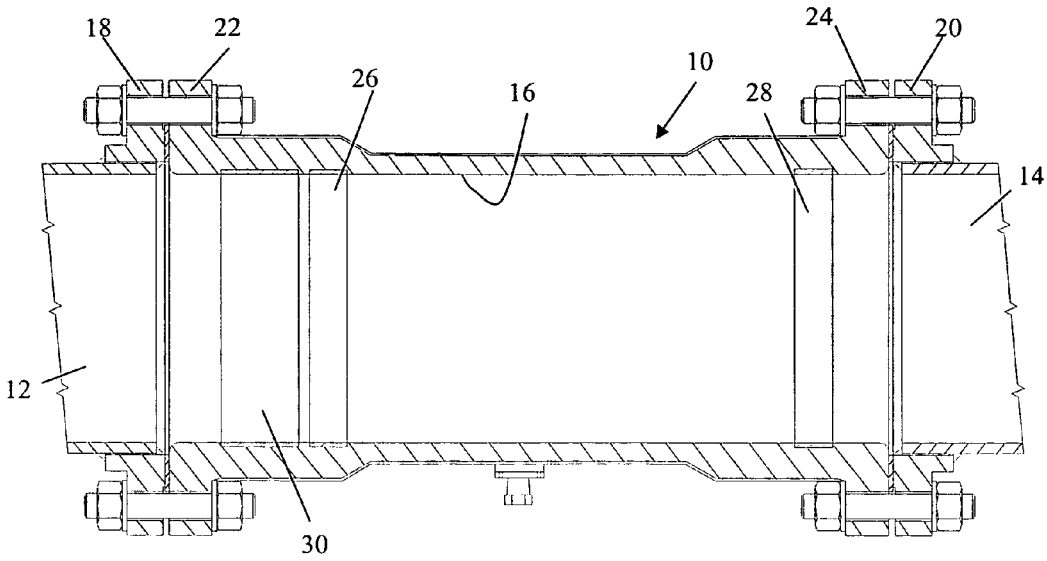
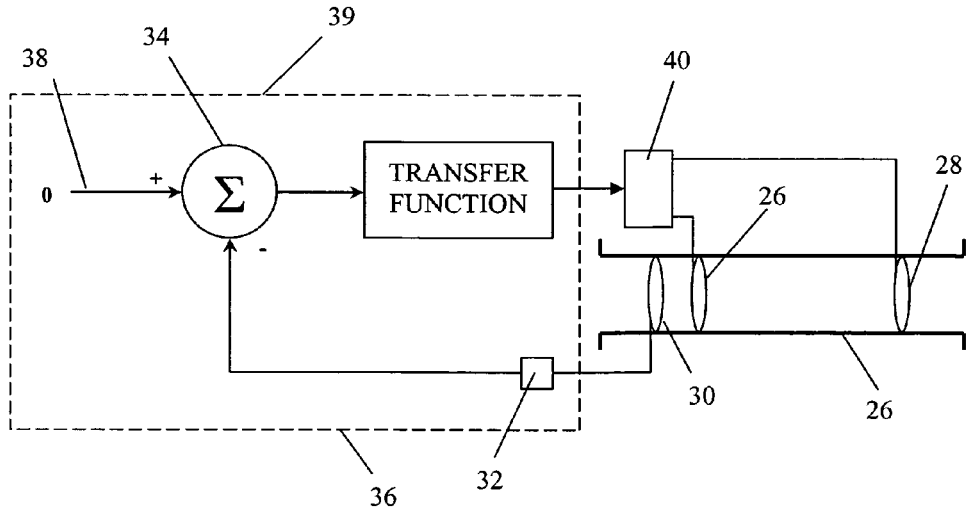
Fig. 2

Fig. 3
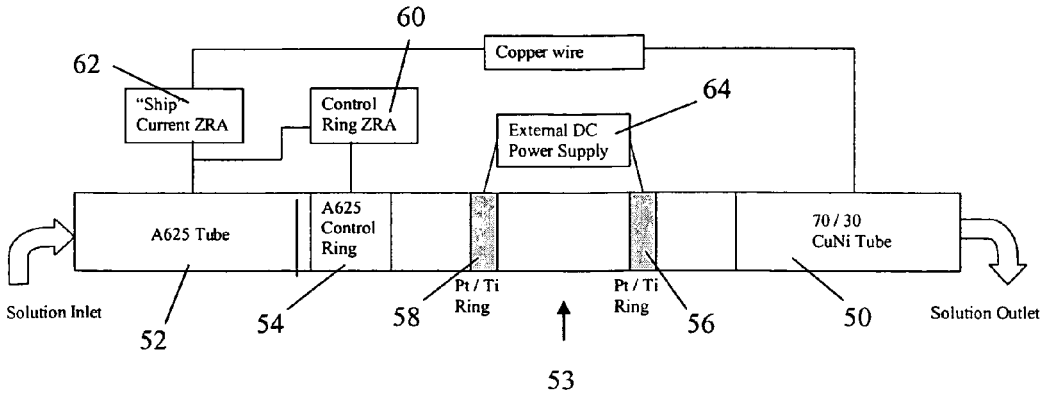
Fig. 4
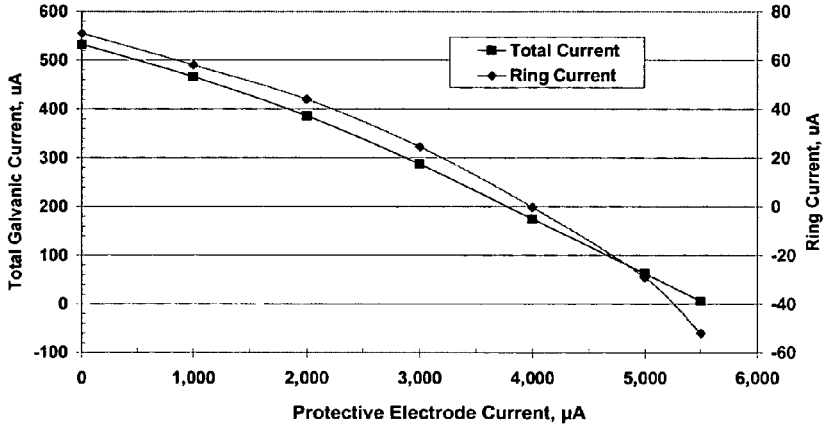
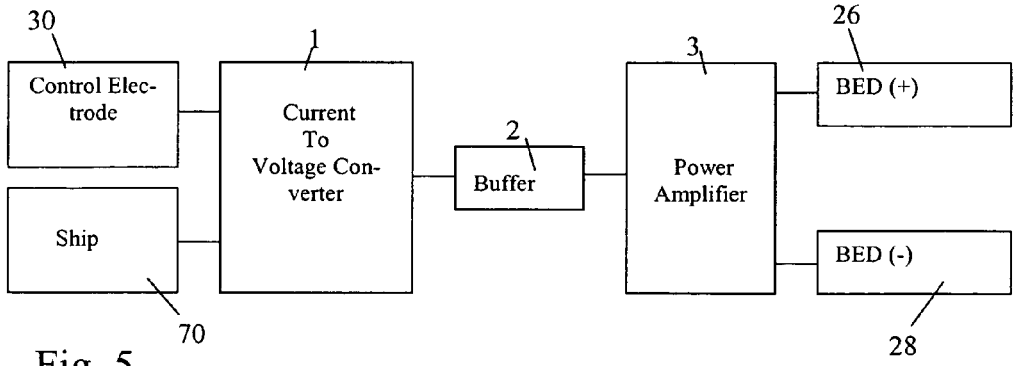
Fig. 5

CONTROL FOR GALVANIC CORROSION INHIBITING COUPLING

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to electrochemistry and preventing galvanic corrosion in piping systems that convey fluid electrolytes through adjoining pipes constructed of dissimilar metals and more particularly relates to a control system for a galvanic corrosion inhibiting pipe coupling.

2. Description of the Related Art

Seawater piping systems on ships and on shore facilities frequently contain dissimilar metal interfaces that pose galvanic corrosion problems. The corrosion is the result of the oxidation that occurs at the more active metal when a relatively more noble metal and a relatively more active metal are in electrical contact with an electrolyte and are conductively connected together through an external circuit. It is desirable that this galvanic corrosion be minimized to reduce the life cycle costs of these systems. One promising technology to mitigate galvanic corrosion in dissimilar metal piping systems is the galvanic corrosion inhibiting coupling that is described in my U.S. Pat. No. 5,739,424 which is herein incorporated by reference.

The galvanic corrosion inhibiting coupling described in the patent is mounted between the ends of two dissimilar metal pipes. The tubular interior walls of the pipes and the coupling define the fluid conveying chamber. Longitudinally spaced, annular electrodes are mounted in grooves formed in the tubular interior wall of the coupling. These protection electrodes, which are sometimes also referred to as bi-electrodes, are in electrical contact with the fluid electrolyte within the chamber. A current source is electrically connected to the protection electrodes through penetrations in the sidewall of the coupling. An electrical current is generated through the electrolyte between the protection electrodes creating an ohmic potential drop in the fluid. This potential drop in the fluid minimizes the galvanic corrosion potential shift of the pipes from the native potential that would exist in the absence of the dissimilar metal couple. One of the protection electrodes, with positive polarity, functions as the anode and the other protection electrode, with negative polarity, functions as the cathode in the galvanic corrosion inhibiting coupling. When the voltage applied to the protection electrodes creates a sufficient ohmic potential drop in the fluid between the dissimilar pipes, each pipe "sees", in the direction of the other pipe, a potential substantially equal to its own native potential. Therefore, the potential difference of each galvanic cell is greatly reduced resulting in greatly reduced galvanic current.

It is desirable to automatically adjust the voltage applied to the protection electrodes during the operating lifetime of the galvanic corrosion inhibiting coupling because scale build up and the development of protective oxides on the interior walls of the pipes and variations in the electrolyte within the pipes cause variations of the potentials of the two dissimilar pipes. Consequently, the ohmic potential drop in the electrolyte that results from the applied voltage is desirably adjusted to compensate for variations in the potentials of the pipes in order to maintain maximum protection.

The above patent suggested that the voltage applied to the protection electrodes be controlled using a pair of sensor electrodes that are located near the ends of the coupling, one sensor electrode near each of the dissimilar pipes. The sensor electrodes sought to continuously sense the potential of each of the two pipes by means of their close proximity to those pipes. In that arrangement, the voltage applied to the protection electrodes was adjusted as a function of the voltage difference between the pair of sensor electrodes. The voltage applied to the protection electrodes was made proportional to the sensed potential difference between the pipes.

However, this system of sensing the potential difference between two sensor electrodes as an approximation of the pipe potential difference has been found inadequate. The rate of galvanic corrosion is a function of the galvanic current flowing through the electrolyte between the dissimilar metal pipes.

In the original demonstration work described in my above patent, in association with FIG. 7 of that patent, the galvanic current flowing between the dissimilar metal pipes was measured directly in the external circuit and this external return current could be used to demonstrate the effectiveness of the concept. However, on a shipboard or on-shore application, all of the piping typically is grounded together to a common ground at multiple locations along the piping to minimize the risk of electrical shock and to prevent static charge build-up. This multi-location grounding creates multiple paths for the galvanic current flow in the external circuit. Consequently, the external circuit current can not be monitored in a practical manner. Thus, the galvanic current is not directly measurable in actual shipboard or shore implementations of the invention in my above patent.

It is therefore an object and feature of the invention to provide a control circuit and method for automatically controlling the galvanic corrosion inhibiting coupling described in my above patent.

BRIEF SUMMARY OF THE INVENTION

The invention is a pipe coupling for joining two electrolyte-conveying pipes of electrochemically dissimilar metals. It has a tubular pipe coupling with a pair of axially spaced protection electrodes mounted to its interior wall as described in my U.S. Pat. No. 5,739,424. A control electrode is mounted to the interior wall of the tubular pipe coupling between one of the pipes and the pair of protection electrodes. A current sensing circuit is connected to the control electrode and a controllably variable electrical power source is connected to the pair of protection electrodes. A negative feedback control circuit has an input connected to the output of the current sensing circuit to receive a feedback signal. The output of the control circuit is connected to the variable source and controls the source so that it applies an electrical current through the protection electrodes and the electrolyte that reduces, and preferably nulls, the magnitude of the sensed control electrode current and thereby reduces galvanic current between the pipes. The control electrode has the same composition as one of the pipes and is positioned between that pipe and the protection electrodes.

In operation, a protection current is applied through the electrolyte between the pair of protection electrodes and the electrical current through the control electrode is sensed. The protection current is adjusted to reduce the magnitude of the sensed current, preferably to zero. In steady state conditions, adjustment of the protection current to bring the sensed current to zero minimizes the galvanic current between the pipes and therefore minimizes corrosion resulting from that galvanic current.

BRIEF DESCRIPTION OF THE SEVERAL VIEWS OF THE DRAWINGS

FIG. 1 is a view in axial section of a galvanic corrosion inhibiting coupling embodying the present invention.

FIG. 2 is a conceptual schematic of the principles of the invention.

FIG. 3 is a schematic of an experiment used to evaluate the principles of the present invention.

FIG. 4 is a graph of the total galvanic current and the control electrode current measured in the experiment illustrated in FIG. 3.

FIG. 5 is a block diagram of a control circuit implementing an embodiment of the invention.

Figure 6:
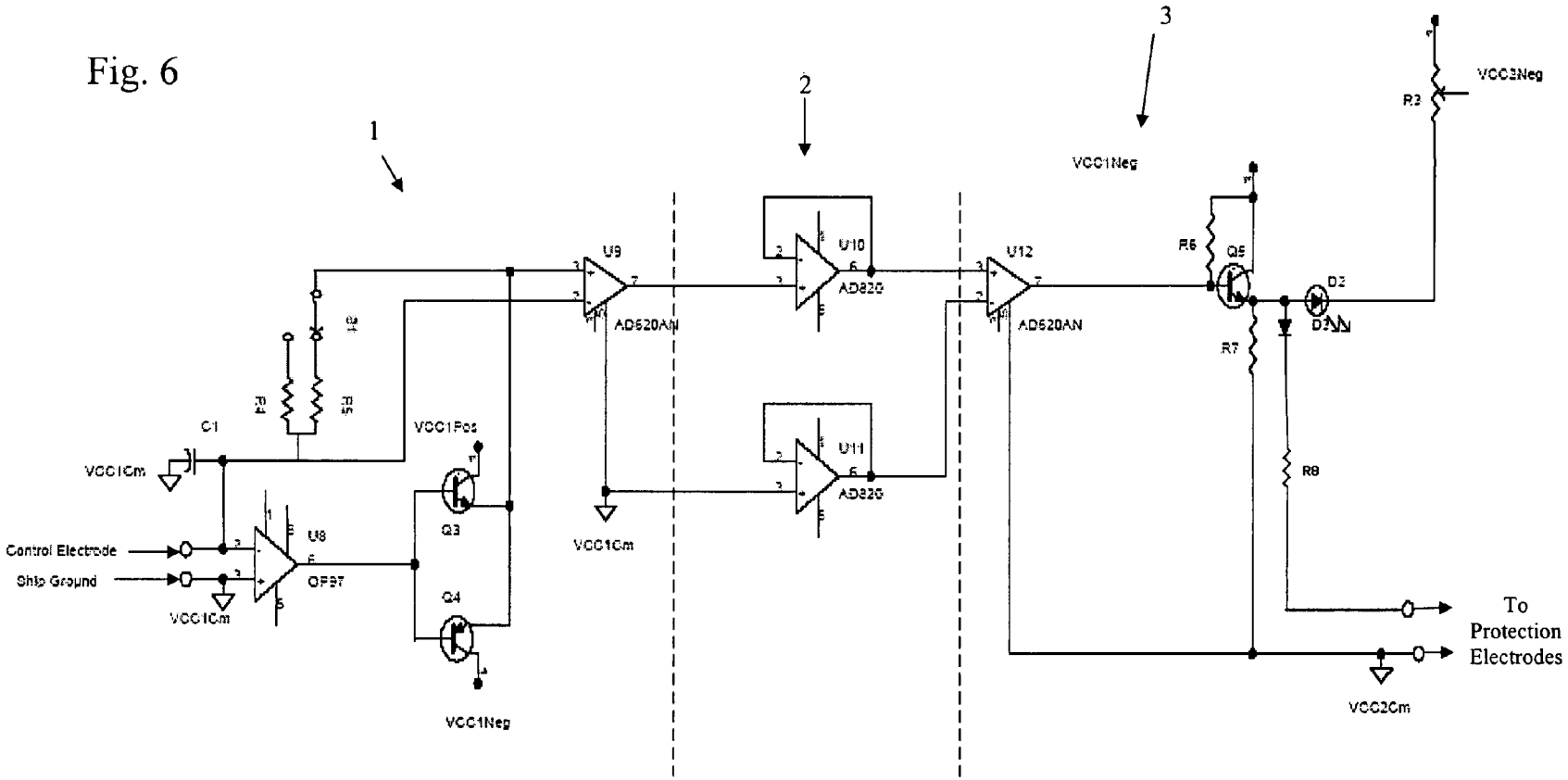
FIG. 6 is a schematic diagram of an example of a control circuit applying the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected, or term similar thereto, is often used. They are not limited to direct connection, but include connection through other circuit elements where such connection is recognized as being equivalent by those skilled in the art. In addition, many circuits are illustrated that are of a type which performs well known operations on electronic signals. Those skilled in the art will recognize that there are many, and in the future may be additional, alternative circuits which are recognized as equivalent because they provide the same operations on the signals.

DETAILED DESCRIPTION OF THE INVENTION

FIG. 1 illustrates a galvanic corrosion inhibiting coupling 10 joining two electrolyte-conveying pipes 12 and 14. The pipes are constructed of electrochemically dissimilar metals. For example, the pipe 12 may be a nickel based alloy, Inconel 625, and the pipe 14 a Cu-30 Ni alloy. Consequently, the pipe 12 is the relatively more noble metal and the pipe 14 is the relatively more active metal. The coupling 10 is tubular and has an interior wall 16 defining an interior, fluid conveying chamber. The opposite ends of the coupling 10 are adapted for connection to the pipes 12 and 14 so the coupling 10 axially conveys an electrolyte between the pipes. These ends may be conventional in nature such as flanges 18 and 20 that are welded to the pipes 12 and 14 and flanges 22 and 24 formed integrally on the coupling 10 so the respective flanges abut and are bolted together.

The tubular coupling 10 is preferably constructed of an electrically insulating material, such as a plastic or synthetic resin material known in the prior art as an acceptable material for pipes. Fabricating the coupling 10 of an insulating material facilitates avoidance of electrically conductive paths to the electrodes other than the path between the electrolyte and the electrodes and the path between the external circuit conductors and the electrodes. Alternatively, however, the tubular coupling can be constructed of a conductive material but provided with a fully insulating liner or with discrete insulating liners for the electrodes as described in my previous patent. It is also preferred that the entire interior wall surface between the protection electrodes be an electrical insulator for reasons described below.

A pair of axially spaced protection electrodes 26 and 28 are mounted to the interior wall of the tubular pipe coupling 10 for electrical contact with the electrolyte flowing through the coupling 10 as also shown and explained in the above cited patent. These protection electrodes 26 and 28 are preferably annular rings mounted in annular grooves formed in the interior wall 16 and otherwise constructed in accordance with the principles described in my above patent. The protection electrodes 26 and 28 are also preferably constructed of identical, relatively inert metals, most preferably platinum based metals such as platinized titanium.

In addition to the protection electrodes 26 and 28, a control electrode 30 is also mounted to the interior wall of the tubular pipe coupling 10 within an annular groove. This control electrode 30 is axially spaced from and between one of the metal pipes 12 or 14 and the pair of protection electrodes 26 and 28. Importantly, the control electrode 30 is constructed of substantially the same metal as the pipe closer to it. This makes the nearer pipe and the control electrode 30 as substantially electrochemically identical as is practical so that they exhibit substantially the same potential. The control electrode 30 is positioned for electrical contact with the electrolyte flowing through the coupling and is preferably an annular ring mounted in an annular groove like the protection electrodes 26 and 28. In the embodiment illustrated in FIG. 1, the control electrode 30 is constructed of the same more noble metal as the pipe 12. However, the control electrode may alternatively be constructed of substantially the same more active metal as the more active metal pipe 14 and positioned on the opposite side of the tubular coupling 10 between the more active metal pipe 14 and the pair of protection electrodes 26 and 28.

Most preferably, the pipes 12 and 14, all three electrodes 26, 28 and 30 and portions of the tubular pipe coupling 10 that are axially displaced from the electrodes, all have a substantially cylindrical interior surface of the same internal diameter. This provides a flow path through the pipes and coupling that has a uniform cross section and therefore minimizes turbulence and flow resistance.

Preferably, the control ring has an axial length of approximately two inches for couplings smaller than three inches in diameter and four inches for couplings exceeding three inches and up to ten inches. It is also preferred that the control electrode be spaced from the closest protection electrode by substantially one half the internal diameter of the coupling. However, where there are significant limitations on the length of the coupling that do not allow the preferred spacing, the spacing may be, for example, one half inch. The spacing from the control electrode to the closest pipe typically ranges from two inches to six inches.

The operating theory of the control electrode is based on its construction from the same metal as one of the pipes combined with its placement near the pipe constructed of the same metal. As a result of these characteristics, the control electrode functions electrochemically as an extension of the pipe but it is not conductively connected to the pipe through any external circuit, except an external circuit that senses the galvanic current through the electrolyte to the control electrode. Therefore, the galvanic current to the control electrode can be sensed and used as a feedback signal, in a negative feedback control system loop, to control the voltage applied to the protection electrodes and the current through the electrolyte from one protection electrode to the other. In accordance with negative feedback control principles, the difference between the galvanic current sensed through the control electrode and zero is used to drive the voltage and current applied to the protection electrodes to a value that reduces the galvanic current at the control electrode and preferably nulls that current to substantially zero. Those skilled in the art will see that this can be accomplished with a variety of circuits. These include analog feedback control circuits and feedback control circuits implemented digitally, such as with a microprocessor or microcontroller, or with hybrid combinations of the two.

FIG. 2 illustrates the basic concept. The control electrode 30 is connected to a current sensor 32 that applies a signal representing the galvanic current flowing through the control electrode 30 to a summing junction 34 of a negative feedback control circuit 36. The control circuit has an effective reference input 38, preferably representing zero amperes, so that the output of the summing junction 34 represents the error signal, i.e. the difference between zero amperes and the sensed control electrode 30 current. That error signal is applied to a conventional circuit having a high gain transfer function 39 that has its output connected to a controllably variable source 40 of electrical current. The source 40 has its output connected to the protection electrodes 26 and 28 so that the source 40 applies a variable voltage to those protection electrodes in order to controllably vary the current between the control electrodes through the electrolyte. This provides a negative feedback control circuit that applies an electrical current through the protection electrodes and the electrolyte that reduces the magnitude of the sensed current and thereby reduces galvanic current to the pipes. The galvanic current to the pipes is reduced in accordance with the principles of my above cited patent.

The control electrode 30 is preferably positioned as far as is practical from the protection electrodes 26 and 28 and as near to the pipe of the same metal composition as the control electrode 30 as is practical. This is done because the control electrode is functioning as a simulated pipe segment that has the advantage that the galvanic current flowing through it is representative of the galvanic current flowing to its nearby actual pipe that is fabricated of the same metal. Since the control electrode has a considerably shorter axial length than the actual pipe, it will attract a considerably smaller galvanic current than the pipe itself. However, as will be seen from the experiment described below, the galvanic current through the control electrode tracks the galvanic current through the pipe and therefore can be used to adjust the protective current through the protection electrodes.

The protective current flowing between the protection electrodes 26 and 28 is distributed in the electrolyte with a higher current density nearer the outer periphery of the electrolyte. The entire interior wall between the protection electrodes is preferably an electrical insulator so that none of the current flowing between the protection electrodes will flow through a parallel conductive path that would be formed if the surface of the interior wall of the coupling were conductive in the region between the protective electrodes.

All the electrodes are preferably full 360° rings in order to more uniformly distribute the current in the electrolyte. This provides more uniform protection and obtains a sensed current magnitude that is not a function of circumferential position. This configuration also minimizes or eliminates any interference with the fluid flow through the coupling. However, although not preferred, the principles of the invention can be applied with electrodes that extend less than the entire 360° around the interior of the coupling. Alternatively, electrodes that protrude into the fluid conveying chamber of the coupling can also be used, such as bayonet probes extending into the interior of the coupling or a screen or mesh electrode extending between the interior walls. Although probes that extend into the fluid flow path are believed impractical for most applications of the invention because they would interfere with fluid flow through the coupling, they would become practical for relatively low fluid flow rates.

FIGS. 3 and 4 illustrate an experiment that was conducted to determine whether there was a close correlation between the galvanic, corrosion-causing current between the dissimilar pipes and the current through the control electrode. A schematic of the experimental structure is shown in FIG. 3. The experiments were conducted with 1 inch diameter NPS piping including a pipe segment 50 of Cu-30 Ni alloy and a pipe segment 52 of Inconel 625 (a nickel base alloy). The galvanic corrosion inhibiting coupling 53 containing a control electrode 54 and two protection electrodes 56 and 58 was interposed between the pipe segments 50 and 52 of dissimilar metal piping. Each of the pipe segments 50 and 52 was 10 inches (10 pipe diameters) in length and the coupling was 12 inches in length. The spacing of the protection electrodes was 6 inches. The testing was performed in refreshed aqueous 3.5% NaCl solution at ambient laboratory temperature. The galvanic current collected on the control ring electrode 54 was measured with a zero resistance ammeter 60 and the total galvanic current was measured with a zero resistance ammeter 62 both as a function of the current applied by a variable voltage DC power supply 64 through the protection electrodes 56 and 58.

The experimental results are shown in FIG. 4. These data show that the current collected on the control ring electrode 54 follows the total galvanic current as the protection electrode current is increased. This behavior demonstrates that the current collected on the control electrode 54 can be used in a feedback loop to control the operation of the galvanic corrosion inhibiting coupling. The current on the control electrode 54 is considerably smaller than the total galvanic current, which is expected due to the smaller surface area of the control electrode 54 that is in contact with the electrolyte in comparison with the total internal surface area of the pipe 52. It also was observed in the experiment that, as protection electrode current increased, the control electrode current typically passed through zero before the total galvanic current approached zero. Consequently, some residual galvanic current between the pipes would remain if the feedback loop were designed to null the control electrode current. This behavior can be attributed to the more negative free corrosion potentials measured for the control electrode, in comparison with the piping. As known to those skilled in the art, identical metals can exhibit different free corrosion potentials as a result of their surfaces having experienced different histories of exposure to different fluid materials. However, it is expected that, with time, the potential of the control electrode and piping will approach each other as steady state films develop on their surfaces. Thus, this effect is not expected to significantly affect the long-term operation of the control device.

The principal components of a circuit embodying the invention is illustrated in the block diagram of FIG. 5. An input from the ground of the ship 70, which is also the circuit common, is applied to circuit 1. This ship ground input functions as a reference input of zero amperes to the feedback control circuit. The control electrode 30 is also connected to an input of circuit 1 and functions as the feedback signal. The circuit 1 is preferably a zero resistance ammeter that converts the magnitude of the input current of control electrode 30 to an output voltage that is proportional to that input current. Buffer circuit 2 isolates the control electrode current from the output current through the protection electrodes 26 and 28. Buffer circuit 2 has a high input impedance so that it prevents any control electrode current from flowing through the circuit to the protection electrodes 26 and 28. The power amplifier 3 applies a voltage to the protection electrodes 26 and 28 to drive a protection current through electrolyte. Because of the high gain, the power amplifier drives the protection electrodes 26 and 28 to a value that brings the control electrode 30 current to essentially zero in accordance with conventional feedback control circuit principles.

FIG. 6 illustrates the control circuit in detail. The boundaries of the current to voltage converting circuit 1, buffer 2 and power amplifier 3 are illustrated with dashed lines in FIG. 6. The circuits of U8, U9, Q3 and Q4 form the zero resistance ammeter. Switch S1 permits insertion of either R3 or R4 into the circuit to accommodate two different pipe diameters. The circuit component values are: C1=4.7 μf; R3=10 kΩ; R4=1 MΩ; R5=1 MΩ; and R8=100 kΩ.

Figure 7:
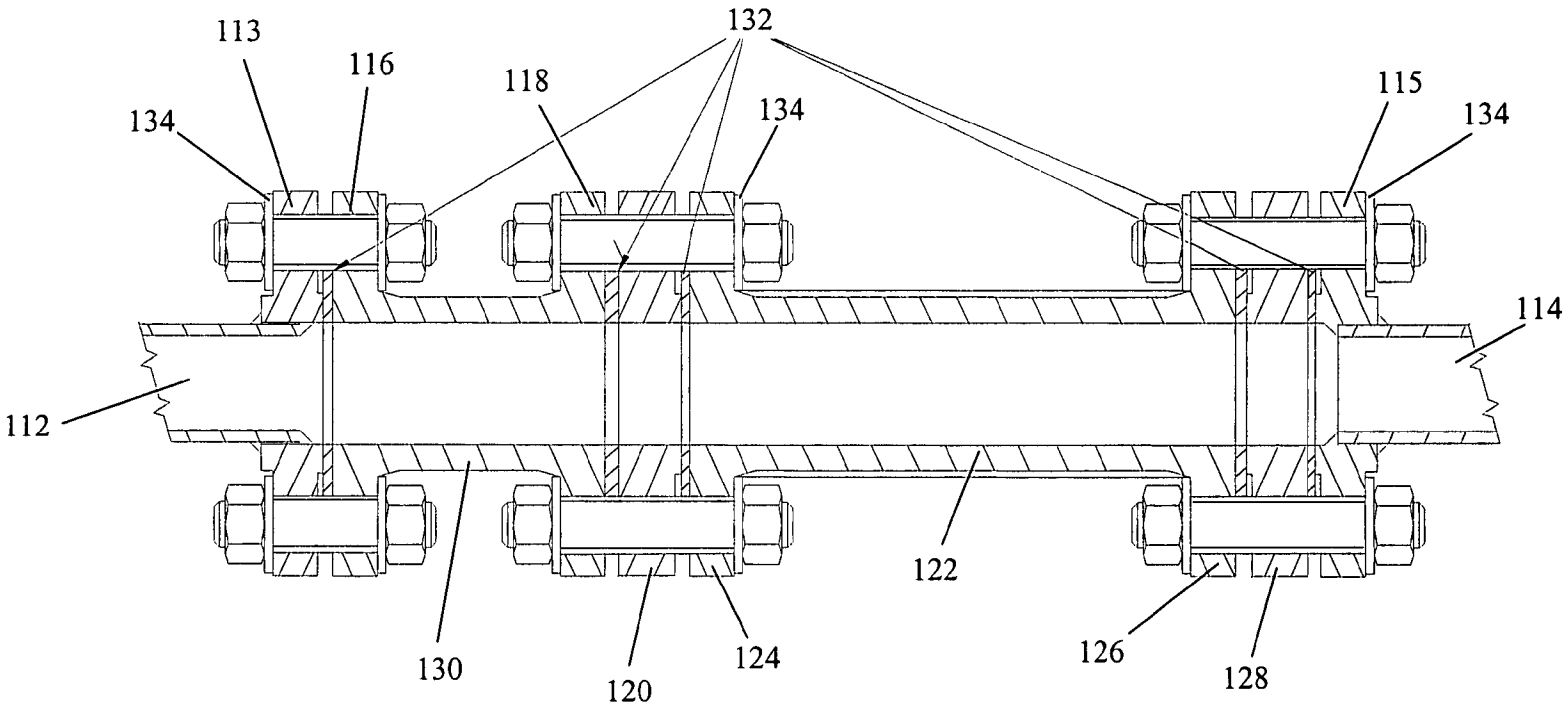
FIG. 7 is a view in axial section of an alternative galvanic corrosion inhibiting coupling embodying the present invention.

FIG. 7 illustrates an alternative pipe coupling embodying the invention and coupling dissimilar pipes 112 and 114, the pipes having respective end flanges 113 and 115 with bolt receiving holes. This embodiment is a longitudinally stacked, array of four segments in the nature of diametric slices. These segments have outer peripheral flanges with bolt receiving holes and are bolted together end to end. However, the segments of this array are electrically isolated from each other and from the pipes they couple. This configuration has several advantages. It avoids potential problems with electrolyte leakage and corrosion of the electrical contacts that might be encountered with a glass reinforced plastic (GRP) design. It also can be used in applications where GRP is not an approved material.

A control electrode 130 is formed in a spool shape with end flanges 116 and 118 having bolt receiving holes. It is constructed of the same metal as the pipe 112. A protection electrode 120 is annular and is provided with an outer flange portion having bolt receiving holes. An electrically isolated spool piece 122 is also provided with similar flanges 124 and 126 at its opposite ends with bolt receiving holes. Spool piece 122 can be made of a non-conductive material, such as GRP, or a metallic material with a non-conductive liner. A protection electrode 128 is annular and is provided with an outer flange portion having bolt receiving holes. The flanges and flange portions of these four components are bolted together by circumferentially spaced bolts in the conventional manner except that they are electrically isolated from each other. The electrical isolation is accomplished by interposing electrically insulative gaskets and sleeves 132 between each pair of connected flanges and in the bolt holes and with electrically insulative washers 134. The spool piece 122 between the protection electrodes must be electrically non-conductive both from the standpoint of electrical conducting through the material as well as through the electrolyte. This can be accomplished by constructing the spool piece of a non conducting material, such as GRP, or of a metallic material with isolating flanges (as described above) and a non-conductive liner in the inside surface.

While certain preferred embodiments of the present invention have been disclosed in detail, it is to be understood that various modifications may be adopted without departing from the spirit of the invention or scope of the following claims.

The invention claimed is:

1. A method for controllably inhibiting the galvanic corrosion resulting from the fluid connection of two electrolyte-conveying, dissimilar, metal pipes electrically connected to a ground, the method comprising:

(a) applying a protection current through the electrolyte between a pair of protection electrodes that are axially spaced from each other, interposed between the dissimilar pipes and in electrical contact with the electrolyte;

(b) sensing the electrical current to ground through the electrolyte and a control electrode in electrical contact with the electrolyte and located between the protection electrodes and one of the metal pipes; and (c) adjusting the protection current to reduce the magnitude of the sensed current;

wherein the method further comprises forming the control electrode of substantially the same metal as one of the pipes and positioning the control electrode between the pipe having substantially the same metal composition as the control electrode and the protection electrodes.

2. A method in accordance with claim 1 and further comprising adjusting the protection current to a magnitude that reduces the sensed current to substantially zero.

3. A pipe coupling for joining two electrolyte-conveying pipes of electrochemically dissimilar metals and inhibiting galvanic corrosion resulting from the dissimilarity, the pipes being electrically connected to a common ground, one pipe constructed of a relatively more noble metal and the other pipe constructed of a relatively more active metal, the coupling comprising:

(a) a tubular pipe coupling having an interior wall defining an interior chamber adapted at its opposite ends for connection to the pipes and axially conveying electrolyte between the pipes;

(b) a pair of axially spaced protection electrodes mounted to the interior wall of the tubular pipe coupling for electrical contact with the electrolyte;

(c) a control electrode mounted to the interior wall of the tubular pipe coupling axially between one of the pipes and the pair of protection electrodes for electrical contact with the electrolyte, the control electrode being constructed of substantially the same more noble metal as the more noble metal pipe and is positioned between the more noble metal pipe and the pair of protection electrodes;

(d) a current sensing circuit having its input electrically connected between the control electrode and ground;

(e) a controllably variable source of electrical current having its output connected to the pair of protection electrodes; and (f) a negative feedback control circuit having an input connected to an output of the current sensing circuit to provide a feedback signal and having an output connected to a controlling input of the variable source for applying an electrical current through the protection electrodes and the electrolyte that reduces the magnitude of the sensed current and thereby reduces galvanic current to the pipes.

4. A pipe coupling for joining two electrolyte-conveying pipes of electrochemically dissimilar metals and inhibiting galvanic corrosion resulting from the dissimilarity, the pipes being electrically connected to a common ground, one pipe constructed of a relatively more noble metal and the other pipe constructed of a relatively more active metal, the coupling comprising:

(a) a tubular pipe coupling having an interior wall defining an interior chamber adapted at its opposite ends for connection to the pipes and axially conveying electrolyte between the pipes;

(b) a pair of axially spaced protection electrodes mounted to the interior wall of the tubular pipe coupling for electrical contact with the electrolyte;

(c) a control electrode mounted to the interior wall of the tubular pipe coupling axially between one of the pipes and the pair of protection electrodes for electrical contact with the electrolyte, the control electrode being constructed of substantially the same more active metal as the more active metal pipe and is positioned between the more active metal pipe and the pair of protection electrodes;

(d) a current sensing circuit having its input electrically connected between the control electrode and ground;

(e) a controllably variable source of electrical current having its output connected to the pair of protection electrodes; and (f) a negative feedback control circuit having an input connected to an output of the current sensing circuit to provide a feedback signal and having an output connected to a controlling input of the variable source for applying an electrical current through the protection electrodes and the electrolyte that reduces the magnitude of the sensed current and thereby reduces galvanic current to the pipes.

5. A pipe coupling in accordance with claim 3 or claim 4 wherein the interior wall of the tubular pipe coupling between the protection electrodes is an electrical insulator.

6. A pipe coupling in accordance with claim 3 or claim 4 wherein the tubular pipe coupling is constructed of an electrical insulator material.

7. A pipe coupling in accordance with claim 3 or claim 4 wherein the control circuit applies a current between the protection electrodes at a magnitude that reduces the sensed current to substantially zero.

8. A pipe coupling in accordance with claim 7 wherein all three electrodes are rings extending annularly around the interior of the tubular pipe coupling.

9. A pipe coupling in accordance with claim 8 wherein the pipes, the rings and portions of the tubular pipe coupling that are axially displaced from the rings all have a substantially cylindrical interior surface of the same internal diameter.

10. A pipe coupling in accordance with claim 9 wherein the control ring has an axial length of at least substantially two inches.

11. A pipe coupling in accordance with claim 9 wherein the control electrode is spaced from the closest protection electrode by substantially one half of said internal diameter.

12. A pipe coupling in accordance with claim 9 wherein the control electrode is spaced from the closest protection electrode by substantially 0.5 inch.

13. A pipe coupling in accordance with claim 9 wherein the control electrode is spaced from the closest pipe by at least two inches.

14. A pipe coupling in accordance with claim 7 wherein the interior wall of the tubular pipe coupling between the protection electrodes is an electrical insulator.

15. A pipe coupling for joining two electrolyte-conveying pipes of electrochemically dissimilar metals and inhibiting galvanic corrosion resulting from the dissimilarity, the pipes being electrically connected to a common ground, one pipe constructed of a relatively more noble metal and the other pipe constructed of a relatively more active metal, the coupling comprising:

(a) a tubular pipe coupling having an interior wall defining an interior chamber adapted at its opposite ends for connection to the pipes and axially conveying electrolyte between the pipes;

(b) a pair of axially spaced protection electrodes mounted to the interior wall of the tubular pipe coupling for electrical contact with the electrolyte;

(c) a control electrode mounted to the interior wall of the tubular pipe coupling axially between one of the pipes and the pair of protection electrodes for electrical contact with the electrolyte;

(d) a current sensing circuit having its input electrically connected between the control electrode and ground;

(e) a controllably variable source of electrical current having its output connected to the pair of protection electrodes; and (f) a negative feedback control circuit having an input connected to an output of the current sensing circuit to provide a feedback signal and having an output connected to a controlling input of the variable source for applying an electrical current through the protection electrodes and the electrolyte that reduces the magnitude of the sensed current and thereby reduces galvanic current to the pipes wherein the coupling comprises a longitudinally stacked array of diametric segments, two of the segments forming said protection electrodes and another of the segments being said control electrode, the electrode segments being electrically isolated from the other electrode segments and from said pipes by insulators interposed between the segments, the segments being fastened together end to end.

* * * * *